US005386614A

United States Patent [19]

Fayngersh

[11] Patent Number: 5,386,614

[45] Date of Patent: Feb. 7, 1995

[54] DOOR CLOSER

[75] Inventor: Zakhary Fayngersh, Hartford, Conn.

[73] Assignee: Corbin Russwin, Inc., Berlin, Conn.

[21] Appl. No.: 1,959

[22] Filed: Jan. 8, 1993

[51] Int. Cl.[6] ..... E05F 3/04

[52] U.S. Cl. ..... 16/51

[58] Field of Search ..... 16/52, 51, 62

[56] References Cited

U.S. PATENT DOCUMENTS

| | | | |
|---|---|---|---|
| 1,770,250 | 7/1930 | Norton . | |
| 2,586,135 | 10/1949 | Woodruff . | |
| 2,701,383 | 4/1950 | Billeter . | |
| 2,723,416 | 11/1955 | Schlage . | |
| 3,574,886 | 4/1971 | Solovieff . | |
| 4,185,356 | 1/1980 | Kuivalainen et al. . | |
| 4,669,147 | 6/1987 | Suchanek | 16/52 |

FOREIGN PATENT DOCUMENTS

| | | | |
|---|---|---|---|
| 705069 | 3/1965 | Canada | 16/62 |

*Primary Examiner*—P. Austin Bradley

*Assistant Examiner*—Chuck Y. Mah

*Attorney, Agent, or Firm*—Darby & Darby

[57] ABSTRACT

A door closer (20) is attachable to a door (24) and includes a cylinder (36) which forms a chamber (44) in which a piston element (50) is movable to move fluid from the chamber to a reservoir (82) upon opening of the door. After the door (24) has been opened to a position, for example, of ninety-five to one hundred degrees, continued opening of the door causes the fluid to be compressed within the chamber (44) and to be directed only through a back check valve (95) to the reservoir (82). This results in the development of an adjustable "back check" condition to provide a counterforce to the continued opening of the door. A passageway (150) is formed in cylinder (36) to allow fluid to flow relatively freely from chamber (44) to reservoir (82) until an inward end (56) of piston element (50) has travelled a prescribed distance "x." This prescribed distance of travel represents the opening of door (24) to ninety-five to one hundred degrees from the door's normally closed position.

4 Claims, 3 Drawing Sheets

DOOR CLOSER

BACKGROUND OF THE INVENTION

This invention relates to a door closer and particularly relates to a door closer with facility for allowing the related door to swing to a relatively wide opening with relative ease before opposition to further opening of the door is increased.

Door closers typically are formed by a cylinder which is coupled to a spring tube to form an enclosed main chamber containing fluid (e.g. oil) within the cylinder and tube. A piston is located within the cylinder for movement within the chamber. At least one coil spring is located within the tube portion of the chamber and is in axial engagement with one end of the piston to normally urge the piston into the cylinder portion of the chamber when the associated door is closed.

An elongated opening is formed through the piston and extends from near one end of the piston to near the other end thereof. One side wall of the elongated opening is formed with teeth to form a rack. A pinion is located within the elongated opening so that the teeth of the pinion mesh with the teeth of the rack.

Driving elements are formed on opposite sides of the pinion and extend through the sidewall of the cylinder to allow coupling of the driving elements and the pinion to facilities external of the cylinder.

A door closer of this type can be mounted on one surface of a door near the top where one of the driving elements is coupled to one end of a first linkage arm. The other end of the first arm is coupled to one end of a second linkage arm for hinged movement relative coupled for pivotal movement to a bracket which is fixedly secured to the door frame.

When the door is in the closed position, the linkage arms are positioned so that the spring is urging the piston into the end of the cylinder portion of the chamber which is furthest from the spring tube. As the door is opened, the linkage arms are moved so that the first arm causes the driving element and pinion to rotate about the axis of the pinion. As the pinion rotates, the mesh of the pinion and rack teeth cause the piston to move against the biasing action of the spring and toward the tube portion of the chamber.

A reserve chamber or reservoir is formed in the cylinder and communicates with the main chamber through a main passageway and a back-check passageway of restricted opening formed in the cylinder wall. As the piston is moved upon opening of the door, some of the fluid is initially urged from the main chamber through the main passageway and the back-check passageway of restricted opening and into the reservoir. Eventually, the piston is moved sufficiently to cover the main passageway whereby the fluid now travels only through the back-check passageway into the reservoir. This condition occurs, for example, when the door is opened about sixty-five to seventy degrees from a closed position. The fluid now begins to be compressed within the main chamber with the only outlet being through the back-check passageway and thereby provides a "back check" condition to prevent the door from being swung open too swiftly.

A door closer of the type described above is also described and claimed in applicant's copending U.S. patent application identified by Ser. No. 07/738,636, filed on Jul. 31, 1991.

Due to certain conditions involving use of the door with the door closer, one may wish to be able to more freely open the door by a greater amount before the back-check condition is effected. For example, it may be desirable to open the door with relative ease to a position greater than ninety degrees from the closed position to allow those passing through the door portal to move without the increased opposition to opening of the door which is encountered when the back-check condition is effected.

Thus, there is a need for a door closing having facility for allowing the related door to be opened with relative ease to a position greater than ninety degrees and prior to any increased opposition to the opening of the door by the occurrence of the back-check condition.

SUMMARY OF THE INVENTION

It is, therefore, an object of this invention to provide a door closer which allows free opening of a related door to a relatively wide position before occurrence of opposition to door opening by the back-check condition.

Another object of this invention is to provide a door closer which allows a related door to be opened essentially freely to a position at least ninety degrees from the closed position whereafter opposition to further door opening is increased through a back-check valve.

With these and other objects in mind, this invention contemplates a door closer for connecting to and controlling the selective application of a counter force to the opening of a door which includes a housing having a chamber formed therein for containing a fluid within the chamber. A piston element is located in a normal position within a first portion of the chamber and is movable within the chamber. The piston element is formed with a forward face which is located normally within the chamber in a plane which separates the first portion and a second portion of the chamber. Means, responsive to external forces, are provided for moving the piston element into the second portion of the chamber to initiate compression of the fluid therein. At least one passageway is formed in the housing and is located a prescribed distance from the forward face of the piston element when the piston element is in the normal position. The prescribed distance is representative of the door being opened by at least ninety degrees from a closed position. The passageway is in communication with the second portion of the chamber to allow at least portions of the compressing fluid to be moved out of the chamber and through the passageway upon movement of the piston element into the second portion of the chamber. Means are provided for developing a counterforce to the continued opening of the door after the forward face has moved past the passageway.

Other objects, features and advantages of the present invention will become more fully apparent from the following detailed description of the preferred embodiments, the appended claims and the accompanying drawings.

DETAILED DESCRIPTION OF THE PREFERRED EMBODIMENTS

Figure 1:
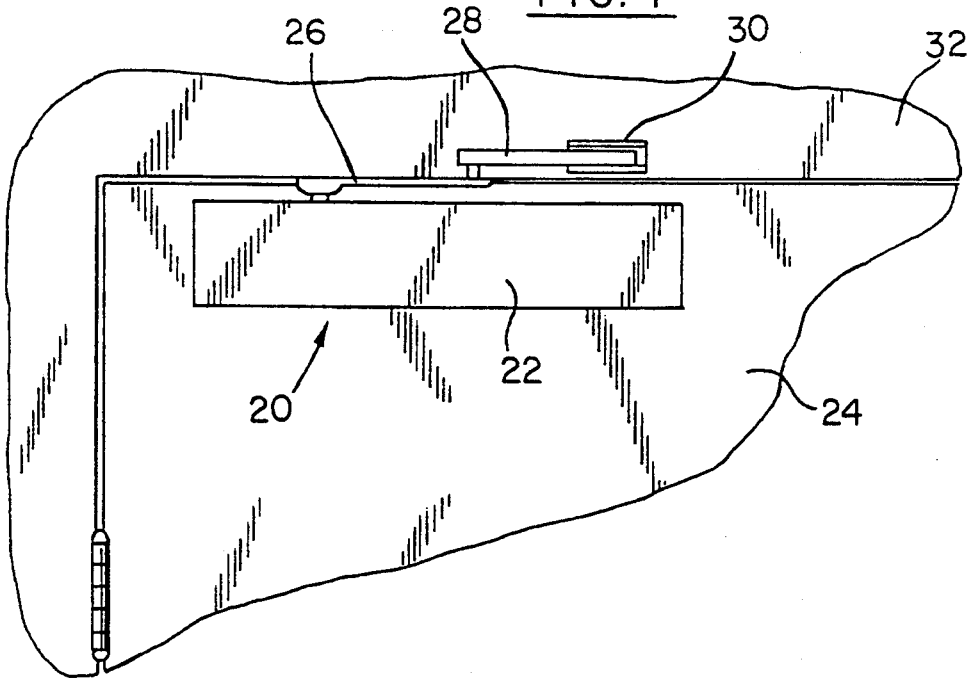
FIG. 1 is a partial front view showing a door closer in assembly with a door and related door frame.
Figure 2:
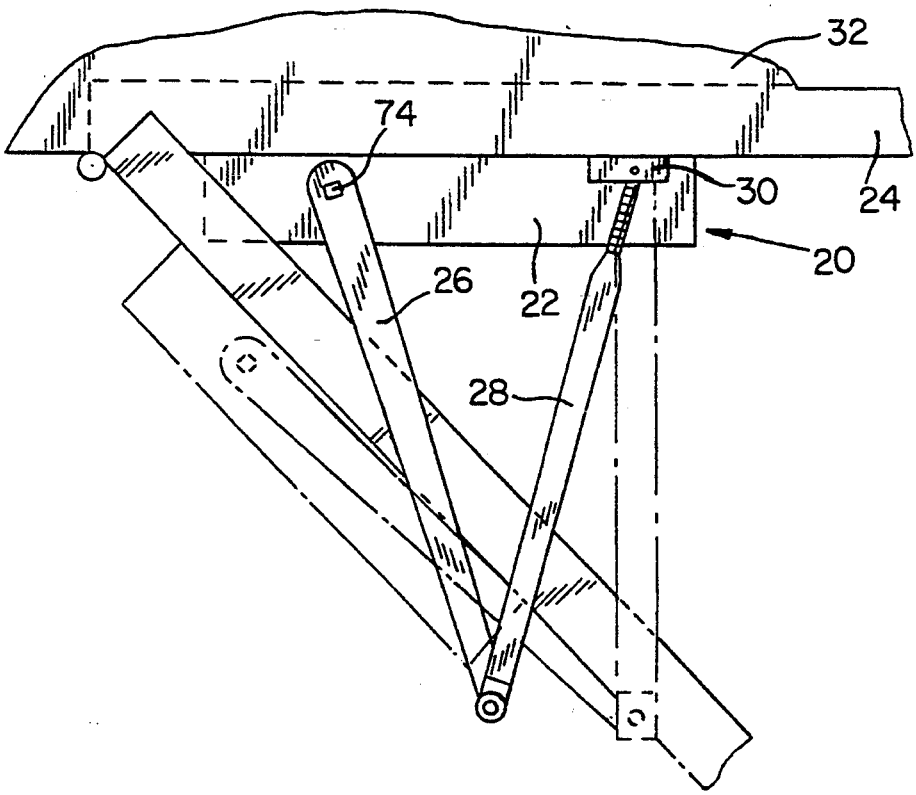
FIG. 2 is a top view of the door closer of FIG. 1 showing the door in a closed position and in an open position of less than ninety degrees from the closed position.
Figure 3:
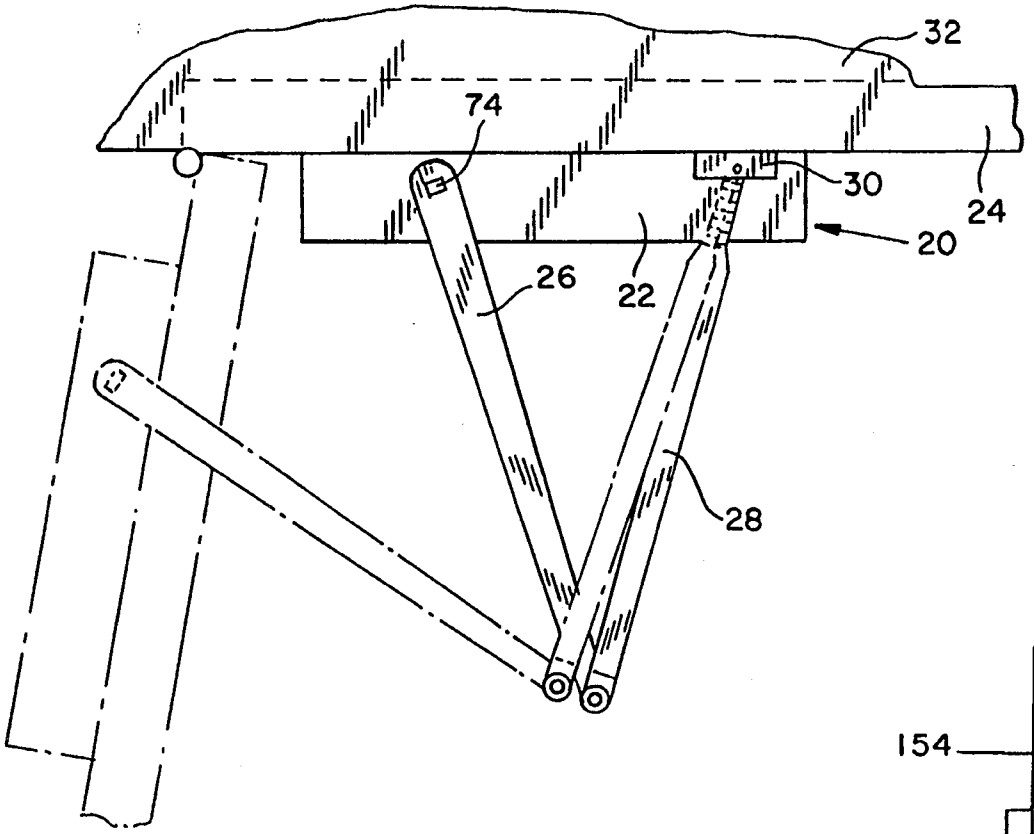
FIG. 3 is a top view of the door closer of FIG. 1 showing the door in the closed position and in an open position of more than ninety degrees from the closed position.

Referring to FIGS. 1, 2 and 3, a door closer 20 is enclosed within a cover 22 and is typically mounted to the upper surface of a door 24 such as a heavy duty door. One end of a first actuator arm 26 is coupled for pivoting movement to door closer 20 and is connected for pivoting movement to a second actuator arm 28. The other end of arm 28 is connected for pivoting movement to a bracket 30 which is mounted on a door frame 32 associated with door 24.

Referring to FIG. 2, as door 24 is opened, or closed, arm 28 is pivoted with respect to bracket 30 and results in pivoting movement of arm 26 which is coupled to door closer 20. As door 24 is opened, a mechanism within door closer 20 is operated to provide opposition to the rapid opening of the door and eventually to provide a back pressure when the door reaches, for example, an opening of sixty-five to seventy degrees which is represented in phantom in FIG. 2. It then becomes increasingly more difficult to open the door to a full open position. In effect, then, door closer 20 provides a back pressure as the door is opened to these positions to establish a "back check" condition as if there was a physical impediment in the path of the door which must be overcome to open the door further. This feature is useful, for example, where heavy doors are used and where the rapid opening of such doors could result in serious injury to anyone near the opening side of the door or could result in serious and costly damage to the door and surrounding structure.

Door closers of the type described in the preceding paragraphs have been used in the past and are also described and claimed in applicant's copending U.S. patent application identified by Ser. No. 07/738,636 which was filed on Jul. 31, 1991.

As shown in FIG. 3, the preferred embodiments of the invention include provision for opening door 24 from a closed position to an open position of at least ninety degrees from the closed position, and preferably in a range of ninety-five to one hundred degrees, before application of the opposition to opening of the door as provided by the back pressure. The illustration of FIG. 3 represents a door opening in the preferable range of ninety-five to one hundred degrees from the closed position of door 24.

Figure 5:
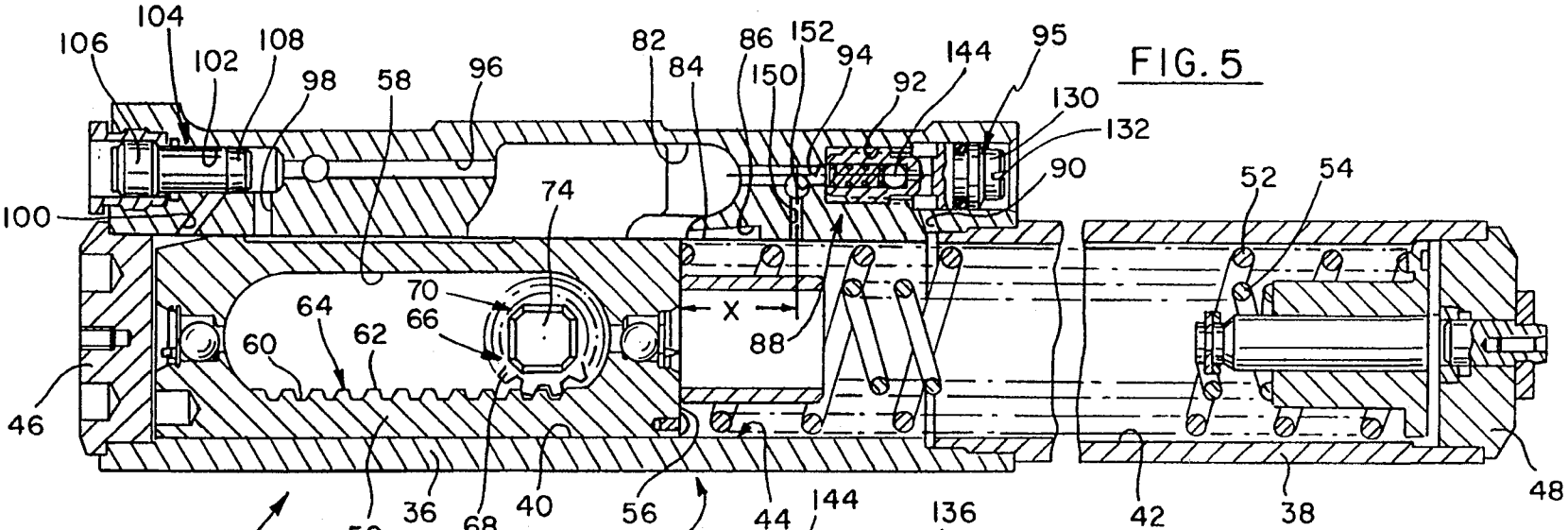
FIG. 5 is a sectional view of a door closer embodying certain principles of the invention.

As shown in FIG. 5, one of the preferred embodiments of the invention includes the door closer 20 with a housing 34 formed by a cylinder 36 and a spring tube 38 threadedly joined together. Cylinder 36 and spring tube 38 are assembled together in axial alignment so that a cylinder opening 40 and a tube opening 42, respectively, join to form a chamber 44. A first cap 46 is located over one end of cylinder 36 and a second cap 48 is located over one end of spring tube 38 to enclose chamber 44 between the caps.

A piston element 50 is located normally in a first portion of chamber 44 generally defined by about two-thirds of opening 40 of cylinder 36. A pair of compression springs 52 and 54 are captured within chamber 44 between an inward end 56 of the piston element 50 and the tube cap 48. Springs 52 and 54 are located in a second portion of chamber 44 defined by the remaining one-third of cylinder opening 40 and all of tube opening 42. Further, the second portion of chamber 44 which includes springs 52 and 54 is typically filled with a fluid such as, for example, oil which is not readily compressible.

Piston element 50 is formed with an elongated opening 58 which is enclosed at the axial ends thereof but is open from side to side. An elongated wall 60 of opening 58 is formed with teeth 62 which extend inwardly of the opening to form a rack 64. A driving pinion 66 having teeth 68 about the periphery thereof is located within opening 58 at one end thereof as illustrated in FIG. 5 with the teeth of the pinion being in mesh engagement with the teeth 62 of rack 64. A pair of coupling elements (not shown) which are capped by square heads 74 and 76 (FIG. 4), respectively, are formed integrally with pinion 64 and extend axially from opposite sides thereof to locations externally of cylinder 36.

Figure 4:
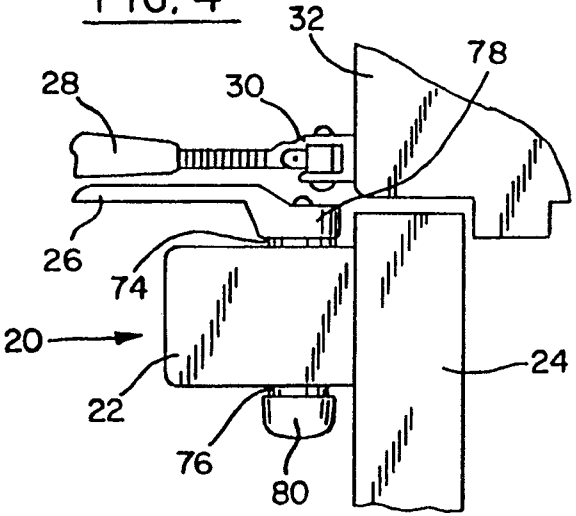
FIG. 4 is a side view showing the door closer of FIG. 1 in assembly with the door and related door frame.

Referring to FIG. 4, a hub end 78 of arm 26 is located over square head 74 for driving connection therewith. In this arrangement, square head 76, which is not used, is covered by protective cap 80.

Referring again to FIG. 5, a reservoir 82 is formed at the side and extends from the top to the bottom of cylinder 36 and communicates with chamber 44 through an opening 84. Further, a bevelled slot 86 is formed in cylinder 36 to provide another path of communication between chamber 44 and reservoir 82 through opening 84. As viewed in FIGS. 5 and 6, a passageway 88 is formed in cylinder 36 for providing another path of communication between chamber 44 and reservoir 82 and includes a flow passage 90, a valve chamber 92 and a flow passage 94. A valve 95 embodying certain principles of the invention is threadedly located within valve chamber 92 the axis of which is parallel to the longitudinal axis of cylinder 36.

Referring again to FIG. 5, other flow passages 96, 98 and 100 are formed in conjunction with a valve chamber 102 to provide still another communication passageway between chamber 44 and reservoir 82. A threaded valve 104 is located in valve chamber 102 and is formed with a slotted head 106 at one end and a tapered portion 108 at the other end. Valve 104 can be adjusted threadedly within chamber 102 to position the valve and the tapered portion 108 thereof to control the flow rate of the fluid through passages 98 and 100, valve chamber 102, passage 96 and into reservoir 82. A valving arrangement such as that which includes valve 104 is used to control the allowable speed of door closing at the time of latching.

Figure 6:
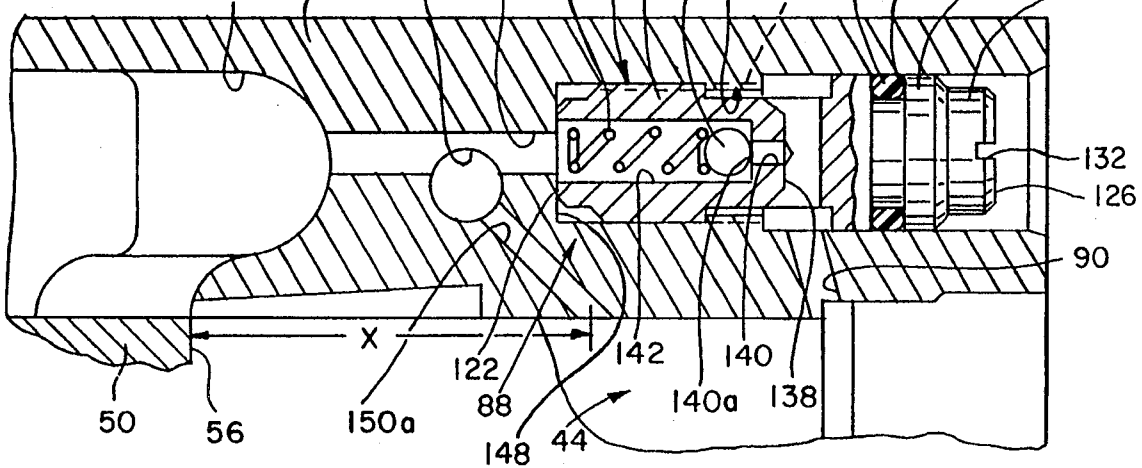
FIG. 6 is an enlarged sectional view of a portion of the door closer of FIG. 5 further showing features embodying certain principles of the invention.

Referring now to FIGS. 5 and 6, back check valve 95 includes a threaded portion 120 at one end 122 thereof which is threadedly positionable within a threaded portion 124 of valve chamber 92. Another end 126 of valve 95 is formed with a slide portion 128 and an external head 130 with a slot 132 to facilitate threaded mounting of the valve within chamber 92. Slide portion 128 is formed with an annular groove 134 and receives a pliable "O" ring 136. Back check valve 95 is also formed with a transverse passage 138, axial passage 140 and chamber 142. Passage 138 is in communication with passage 140 which, in turn, is in communication with chamber 142. A spherical member or ball 144 is positioned within chamber 142 adjacent to port 140*a* associated with passage 140 and is normally held in this position by a compression spring 146 after valve 95 has been threadedly seated in chamber 92 as illustrated in FIGS. 5 and 6. Literally, then, ball 144 closes port 140*a* until the ball is urged toward the other end of chamber 92 against the biasing action of spring 146.

When valve 95 is used in the manner described in applicant's above-noted copending U.S. patent application, the valve is threadedly mounted into chamber 92 as illustrated in FIGS. 5 and 6. In this position, the tail portion of compression spring 146 is resting against end wall 148 of chamber 92 to apply a compressing force against ball 144. This action urges ball 144 into blocking position over port 140*a*.

The compression force applied by spring 146 against ball 144 can be adjusted as desired by the location of valve 95 within chamber 92. This will establish the level of force of the fluid as applied against ball 144 at port 140*a* necessary to overcome the force of spring 146 to thereby allow the ball to be moved from the port and fluid to pass through the port. For example, as illustrated in FIGS. 5 and 6, valve 95 is assembled fully within chamber 92 so that valve end 122 seats against end wall 148 of chamber 92. In this position, spring 146 is compressed to the maximum level and thereby applies the maximum force possible to hold ball 144 over port 140*a*. The force of the fluid being compressed in chamber 44 must exceed the level of force applied to ball 144 by spring 146 to cause the ball to be moved from port 140*a*.

If valve 95 is adjusted so that valve end 122 is not in engagement with chamber wall 148, spring 146 expands and is relaxed in comparison to the maximum available compression described above. In the relaxed condition, the force applied by spring 146 against ball 144 is less than the maximum force noted above. Thus, the force of the fluid against ball 144 required to overcome the force applied by relaxed spring 146 is less than the force of the fluid noted above when the spring was in the maximum force condition.

With this flexibility, the arrangement of ball 144 and spring 146 with valve 95 permits adjustment of the valve to many selectable positions to develop the desired level of force which the compressing fluid must present in the establishment of the "back-check" condition.

When valve 95 is mounted within chamber 92 as illustrated in FIGS. 5 and 6, transverse passage 138 of the valve is in communication with passage 90 of cylinder 36 while chamber 142 of the valve is aligned and in communication with passage 94 of the cylinder.

As piston element 50 is moved to the right (FIG. 5) upon the opening of door 24, fluid is moved through passage 90, into passage 138 and further into passage 140. The force of the fluid upon ball 144 will attempt to move the ball against the biasing action of spring 146. Also, "O" ring 136 forms a seal against the wall of chamber 92 to preclude any fluid from leaking toward the open end of the chamber adjacent head 130. If piston element 50 has not been moved past opening 84 and slot 86, door 24 is being opened with only moderate opposition offered mainly by springs 52 and 54. In this mode, the force of the fluid against ball 144 is not sufficient to move the ball slightly away from port 140*a* to allow fluid to flow into chamber 142 and eventually through passage 94 into reservoir 82. Again, since piston element 50 has not been moved past opening 84 and slot 86, door 24 continues to be moved with only moderate opposition. Therefore, valve 95 plays no role in offering opposition to the opening of door 24 at this time.

Eventually, door 24 is opened to a position between sixty-five and seventy degrees, for example, as illustrated in FIG. 3 whereby opening 84 and slot 86 are covered by piston element 50 in the manner described above. At this time, any fluid which will flow into reservoir 82 must pass through passages 90, 138 and 140, chamber 142 and passage 94. In order for fluid to pass from passage 140 into chamber 142, the force and pressure of the fluid being compressed by movement of piston element 50 to the right (FIG. 5) must move ball 144 away from port 140*a*. The level of force of the fluid as applied against ball 144 moves the ball against the biasing action of spring 146 and thereby overcomes, partially, the compressing force of the spring. As ball 144 is moved away from port 140*a*, fluid is then allowed to be moved from passage 140 into chamber 142 and eventually into reservoir 82.

Thus, valve 95 is directly responsive to the compressing force being developed by the compression of fluid within chamber 44 upon movement of piston element 50 into the chamber. If door 24 is being opened in a normal manner with moderate force, piston element 50 will move at a pace which allows some of the fluid to move through opening 84 and slot 86 into reservoir 82. Thereafter, the continued application of a moderate force in opening door 24 results in compressing of the fluid within chamber 44. This causes a moderate compression force to be applied against ball 144 to move the ball as noted above a distance away from port 140*a* determined by the instantaneous compression force and the biasing force of compression spring 146. In any event, the opening provided by the space between ball 144 and port 140*a* is sufficient to allow fluid to flow through valve 95 at a rate commensurate with the level of compression force within chamber 44 required to establish the "back check" condition.

In the event that door 24 is opened in a violent manner, piston element 50 quickly passes by opening 84 and slot 86 and begins to compress the fluid within chamber 44. As the compression force builds rapidly, a force is applied against ball 144 to move the ball from port 140*a*. The compression force developed under the violent-opening condition is much higher than the compression force of the normal opening as described above. In the instance of the violent opening, the force upon ball 144 is significantly greater than the normal-opening force and the ball is moved a greater distance from port 140*a* and thereby allows a higher rate of fluid flow through valve 95. Thus, even though the fluid is being compressed at an extremely rapid rate within chamber 44, the permissible high rate of flow through valve 95 prevents the development of destructive compression forces within the chamber and allows the establishment of the "back check" condition.

Thus, the structure of valve 95 responds to the force of opening door 24, regardless of whether the door is opened in a normal manner with moderate force or in a violent manner with exceptional force, and allows for the development of sufficient counterforce to establish the "back check" condition.

In one embodiment of the invention as illustrated in FIG. 5, a passageway 150 is formed in cylinder 36 which is located between bevelled slot 86 and passageway 90 but is not directly linked thereto. Passageway 150 communicates with chamber 44 at one end thereof and with a chamber 152 at the other end thereof. Further, passage 94 also communicates with chamber 152. Passageway 150 is located by a prescribed distance "x" from inward end 56 of piston element 50 when the element is in a normal or rest position to the left in chamber 44 as shown in FIG. 5. It is noted that inward end 56 of piston element 50 represents a forward face of the piston element with respect to the direction of movement of the element when door 24 is opened.

When door 24 is opened, piston element 50 moves to the right as described above whereby fluid flows through opening 84 and slot 86 into reservoir 82. Some fluid will also flow through passageway 150 and eventually into reservoir 82. However, the compression of the fluid at this stage is insufficient to move ball 144 so that fluid does not flow through back check valve 95 at this time. Eventually, inward end 56 of piston element 50 is moved past opening 84 and slot 86 and the fluid now passes only through passageway 150 into reservoir 82. Even so, door 24 continues to open with relative ease because passageway 150 is of sufficient diameter to allow for the flow of the fluid therethrough without significant counterforce to the opening of the door.

When inward end 56 of piston element 50 has travelled distance "x" door 24 has now been opened at least ninety degrees and preferably with ninety-five to one hundred degrees from the closed position as illustrated in FIG. 3. At this time, passageway 150 is blocked by piston element 50 and the fluid becomes more compressed within tube opening 42. This results in the compressed fluid attempting to and eventually flowing through valve 95 which establishes the back check condition, and the counterforce associated therewith, in the manner described above.

Thus, the placement of passageway 150 by prescribed distance "x" from inward end 56 when the piston element is in the normal rest position provides facility for allowing door 24 to be opened freely and with relative ease to at least ninety degrees, and preferably from ninety-five to one hundred degrees, from the closed position before application of the back check counterforce In another preferred embodiment as illustrated in FIG. 6, a passageway **150*a* is formed at an angle in cylinder 36 instead of passageway 150. Passageway 150*a* is situated in the same general location as passageway 150 and also communicates with chamber 44 and chamber 152 at opposite ends of passageway 150*a*. Passageway 150*a* is located prescribed distance "x" from inward end 56 of piston element 50 and functions in the same manner as described above with respect to passageway 150**.

Figure 7:
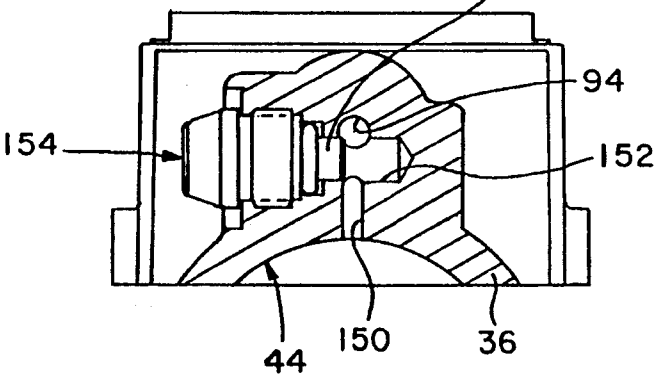
FIG. 7 is a partial sectional view showing a valve arrangement in the door closer of FIG. 1 for adjusting a passageway opening through which pressurized fluid will flow.

Referring to FIG. 7, a valve 154 with a forward section 156 is threadedly mounted in cylinder 36. Valve 154 is positioned so that, upon threaded adjustment of the valve, forward section 156 will restrict the opening between passageway 150, or passageway **150*a*, and chamber 152 and thereby control the rate of flow of fluid through the passageway. Thus, valve 154 provides the ability to introduce a moderate counterforce to the opening of door 24 after inward end 56 has been moved past slot 86. Also, valve 154 can be adjusted to block passageway 150, or passageway 150*a*, so that door closer 22** now functions in the manner described above with respect to the door closer in applicant's above-noted copending U.S. patent application.

The above-described embodiments, of course, are not to be construed as limiting the breadth of the present invention. Modifications, and other alternative constructions, will be apparent which are within the spirit and scope of the invention as defined in the appended claims.

What is claimed is:

1. A door closer for connecting to and controlling the selective application of a counterforce to the opening of a door, which comprises:

a housing;

a chamber formed within the housing for containing a fluid therein, the chamber being formed with a first portion and a second portion;

a piston element located in a normal position in the first portion thereof when the door is closed, and movable within, the chamber;

the piston element formed with a forward face;

means responsive to forces externally of the chamber for moving the piston element toward the second portion of the chamber to initiate compression of the fluid therein;

at least a first passageway formed in said housing and extending a preselected distance from the forward face of the piston element when the piston element is in the normal position;

said preselected distance being representative of the door beings opened less than ninety degrees from a door position when the door is closed;

at least a second passageway formed in the housing a prescribed distance from the forward face of the piston element when the piston element is in the normal position;

the prescribed distance being representative of the door being opened at least ninety degrees from a door position when the door is closed;

the first and second passageways being in communication with the chamber to allow at least portions of the compressing fluid to be forced out of the chamber and through the passageways upon movement of the piston element within the chamber from its position normally in the first portion of the chamber and until the forward face is respectively moved past the first and second passageways; and means for developing a counterforce to the continued opening of the door after the forward face has been moved past the second passageway.

2. The door closer as set forth in claim 1, wherein the prescribed distance is representative of the door being opened within a range of ninety-five to one hundred degrees.

3. The door closer as set forth in claim 1, wherein the second passageway extends perpendicularly from the chamber.

4. The door closer as set forth in claim 1, wherein the second passageway extends angularly from the chamber.

* * * * *